US005214891A

United States Patent [19]

Edlin

[11] Patent Number: 5,214,891

[45] Date of Patent: Jun. 1, 1993

[54] WALL COVERING ASSEMBLY

[76] Inventor: Richard Edlin, P.O. Box 261094, Encino, Calif. 91426-1094

[21] Appl. No.: 802,807

[22] Filed: Dec. 6, 1991

[51] Int. Cl.[5] ..... E04B 1/00

[52] U.S. Cl. ..... 52/222; 160/327

[58] Field of Search ..... 52/222, 288, 582, 273, 52/716; 160/327, 391, 392, 393, 395, 397

[56] References Cited

U.S. PATENT DOCUMENTS 4,788,806 12/1988 Sease ..... 52/222
4,986,332 1/1991 Lanuza ..... 52/222 X
5,928,897 12/1975 Tombu ..... 160/327 X

FOREIGN PATENT DOCUMENTS 2225599 11/1974 France ..... 160/327

*Primary Examiner*—Carl D. Friedman
*Assistant Examiner*—Creighton Smith
*Attorney, Agent, or Firm*—John J. Posta, Jr.

[57] ABSTRACT

The wall covering assembly includes a flexible, resilient, preferably sound-deadening, fire-resistant sheet of wall covering, preferably of plastic and/or cloth. The assembly also includes one or a spaced number of preferably parallel wall covering anchoring strips releasably connected to the rear of the wall covering. The strips can be anchored to the exposed surface of a wall to hold the wall covering over and spaced from the wall. Each strip may be of flexible material, such as plastic, metal, or the like and includes a first member having a rear plate adapted to be connected, as by adhesive, screws, etc., to a wall. The rear plate has a toothed upper end. That member also includes a front plate spaced forward of the rear plate by spaced top and bottom struts, preferably parallel with each other and defining therebetween a box having an acoustical space below the top of the rear plate. The front plate may bear anchoring hooks attachable to the rear of the wall covering. Alternatively, it may have a strip of cushioning material.

Each strip also has a second member sliding with and extending over the first member and including a base plate slideable on the top strut and a curved resilient plate extending upwardly and rearwardly ovet the top strut and terminating in a toothed rear depending lip abutting the toothed top end of the rear plate. The opposed toothed surfaces releasably grip an end of the wall covering. The base plate has a connector depending therefrom and slideably keyed to the first member thru a slot in the top strut. The second member slides relative to the first member. The assembly may be in the form of a prefabricated panel using a baseboard with strips secured to the top, and a wall covering secured at its ends to the strips. The baseboard has hanging members for securing the panel to a wall.

Alternatively, the strips can be overlaid, pressed together and interlocked to assemble, rather than sliding one into the other.

18 Claims, 2 Drawing Sheets 46d
48d
40d
50d
12d
18d
74
28d
27d
25d
42d
72
54d
37d
20d
26d
34d
30d
10d
32d
72
30d
32d
26d
19d
34d
37d
54d
28d
40d
25d
42d
74
50d
46d
27d
48d

WALL COVERING ASSEMBLY

BACKGROUND OF THE INVENTION

1. Field of the Invention

The present invention generally relates to wall covering assemblies and more particularly to an improved wall covering assembly which provides improved acoustical properties and enables a wall covering to be smoothly reflected over an irregular wall surface while providing increased design flexibility.

2. Prior Art

Various systems have been provided for covering walls. Usually, walls are merely painted. In some instances they are covered with wall paper or wall cloth. In other instances they are covered with rigid acoustical or non-acoustical paneling. One recent assembly has employed flat plastic strips bearing hooks on their exposed surfaces. The strips are adhesively connected to a wall or screwed in place, after which a flexible wall covering is hooked to the strips to closely overlie the wall. Although this system is an improvement over many other wall covering systems, it does have some drawbacks. Thus, wall surface irregularities show through the closely overlying wall covering, necessitating the use of a perfectly flat wall for best results. Moreover, although the wall covering itself may be acoustical, its placement against the wall does not enhance such properties. Hence, the covering must be relatively thick to have significant sound-deadening properties.

Many other fabric wall-covering systems have been devised. See, for example, U.S. Pat. No. 4,197,686 utilizing complicated one-piece strips requiring installing tools. See also U.S. Pat. Nos. 4,625,490, 3,657,850 and 4,161,977. Most such systems employ one-piece strip components which are difficult to install and to use. Moreover, most such systems have no sound-deadening properties whatsoever, and do not facilitate easy maintenance and deinstallation.

There remains a need for an improved wall covering assembly which can overcome the above-described shortcomings. Such assembly should not only result in improved acoustical properties, but should allow the wall covering to be perfectly smoothly applied to an irregular wall surface and to provide a single fabric system that solves a plurality of installation problems. The assembly should be inexpensive, adaptable to a variety of applications, efficient and durable.

SUMMARY OF THE INVENTION

The improved wall covering assembly of the present invention satisfies all the foregoing needs. The assembly is substantially as set forth in the Abstract of the Disclosure. Thus, the assembly comprises a flexible resilient wall covering which may be of plastic, cloth or the like and may be acoustical and fire retardant.

The assembly further includes one or a plurality of parallel elongated straight wall covering anchoring strips. Each strip has two members. The first member has a generally flat rear plate end of which is toothed, and a generally flat front plate spaced well in front of the rear plate by integral flat top and bottom struts, the two plates and struts defining therebetween an open-sided box having an acoustical space. The front plate may bear on its front surface a plurality of spaced hooks releasably engaging the rear of the wall covering to hold it in place spaced in front of a wall, when the rear plate is anchored to the wall, as by adhesive, screws, bolts or the like.

Each strip also includes a second member slidable within and extending above the first member. The second member has a base plate which slides on the top of the top strut, and a curved resilient plate integral with the front end thereof, extending up and back thereover, and terminating in a depending toothed lip abutting the toothed upper end of the rear plate. The wall covering abuts the front plate and curved plate and has an end releasably gripped by the opposed teeth. The second member is keyed to the first member by a T-shaped connector depending from the base plate thru a longitudinal slot in the top strut.

Since the front and base plates are well apart from each other and a sound-deadening acoustical space is disposed therebetween, the wall covering is held well in front of the wall and does not show through it any wall irregularities. Moreover, the acoustical properties of the wall covering assembly are improved.

The second member can be an interchangeable part of the strips, which can taken the form of a range of commonly specified edge members, such as a "bull-nose", chamfer, miter, or square. A designer can also choose to create his/her own specialized design of the second member.

It is contemplated that fire resistive fabric backing can be secured to the wall covering which is designed to catch the Velcro on the top surface of the first member. This allows for the initial stretching and positioning of the fabric. The backing enhances the acoustical quality and adds to the fire resistiveness of the assembly, while eliminating puckering, sagging, and shadows.

The wall covering itself can be of fire resistive fabric or vinyl that a designer selects. The second member can be secured to the first member by sliding it in from one end or alternatively can be pressed into place by deforming locking members on the first member while receiving the T-shaped connector.

Another embodiment of the invention includes for one or a series of prefabricated panels of wall coverings, adapted to be arranged on a wall and secured in place thereto. These panels can be assembled by securing a pair of spaced opposed strips on a baseboard and securing the wall covering to the strips. The baseboard can have a plurality of wall mounting hooks secured to its underside, which can be attached to a wall, as by mating hooks. A plurality of such prefabricated panels are easy to mount and provide an improved, neat appearance.

Various other features of the present invention are set forth in the following detailed description and accompanying drawings.

DRAWINGS

FIGS. 1 thru 4 are schematic side elevations, partly in section and partly broken away, of, respectively, first, second, third and fourth preferred embodiments of the improved wall covering assembly of the present invention, shown mounted on a wall;

FIG. 5 is a schematic perspective view, partly broken away, of a fifth preferred embodiment of the improved wall covering assembly of the present invention utilizing a pair of the strips of FIG. 3; and, FIG. 6 is an enlarged schematic side elevation of a pair of brackets utilizable with the assembly of FIG. 5.

DETAILED DESCRIPTION

Figure 1

Figure 1:
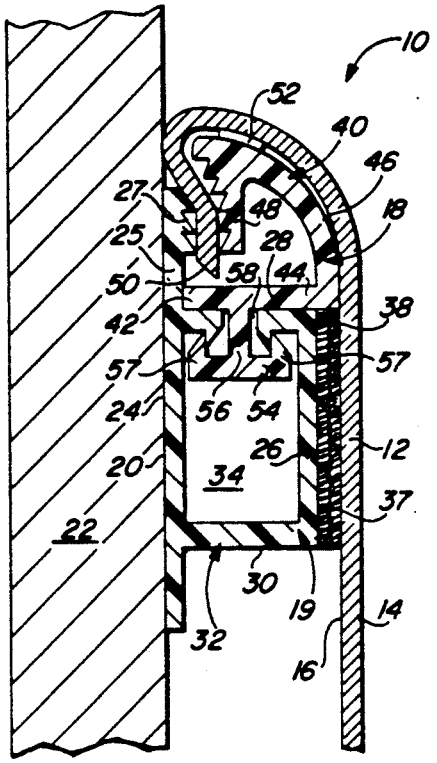

Now referring more particularly to FIG. 1 of the drawings, a first preferred embodiment of the improved wall covering assembly of the present invention is schematically depicted therein installed on a wall.

Thus, assembly 10 is shown which comprises a flexible resilient sheet 12 of wall covering material such as plastic, cloth or the like having a front 14 and rear 16, the latter being adapted to receive and releasably secure anchoring hooks or the like, as hereinafter described. Sheet 12 preferably is fire resistant, decorative and sufficiently thick to have sound-deadening or acoustical properties.

Assembly 10 also includes one or a spaced plurality of elongated wall covering anchoring strips 18, each comprising a first member 19 having a generally flat, vertical, rear plate 20, shown in FIG. 1 as anchored to the exposed surface of a vertical wall 22 by a layer 24 of adhesive or the like. Alternatively, strip 18 could be anchored to wall 22 by bolts, screws or the like (not shown).

Strip 18 may be fabricated from a flexible material such as plastic, metal, or the like. The upper end 25 of rear plate 20 has a toothed front surface 27. Member 19 also includes a generally flat front vertical plate 26 spaced forwardly of and generally parallel to rear plate 20 by integral horizontal top strut 28 and spaced bottom strut 30. Strut 28 is below end 25. Plates 20 and 26 form with struts 28 and 30 on open-sided box 32 defining one or more acoustical, sound-deadening spaces 34 which increase the acoustical properties of assembly 10.

The front surface 36 of plate 26 is provided with a Velcro-type pad 37 having a spaced plurality of hooks 38 which releasably engage rear 16 of sheet 12 to anchor it in place spaced in front of wall 22.

It will be noted that space(s) 34 is sufficiently deep so that sheet 12 stands well away from wall 22 and thus does not show therethrough any irregularities in wall 22. Instead, sheet 12 presents a smooth, continuous uninterrupted surface which increases its decorative effect.

Strip 18 also includes a second member 40 which slides within space 34 and also overlies top strut 28. Member 40 is in one piece and includes a horizontal base plate 42 which rests on and can slide over top strut 28 and to the front 44 of which is integrally connected a curved resilient plate 46 rising above and rearwardly of front 44 and terminating in a rear depending toothed lip 48 abutting toothed front 27 of plate 20. Lip 48 and front 27 releasably grip on end 50 of covering 14, holding it in place.

A Velcro strip 52 can be disposed on plate 46 to releasably hold end 50 while orienting the rest of covering 12. Member 40 is keyed to member 19 by an inverted T-shaped connector 54 depending from plate 42, the neck 56 of which connector 54 passes down through a longitudinal slot 58 in strut 28. Member 40 can be secured to member 19 either by sliding it into member 19 from an open end of box 32 with connector 54 disposed within space 34 or, alternatively, if the assembly is made of plastic or other flexible material, member 40 can be positioned above member 19 and pushed downwards to deform strut 28 and enable connector 56 with flexed extensions 57 to pass through slot 58, with the subsequent return of strut 28 and extensions 57 to their at rest positions to interconnect member 40 and 19.

After member 40 is fully aligned with member 19, covering 12 is then engaged with pad 37 to hold it taut, with the end 50 then passed under flexible lip 48 and passed tooth end 27 to hold end 50 firmly in place. A second strip 18 can be positioned on wall 22 spaced from, parallel to but inverted relative to the position shown for strip 18 in FIG. 1, in order to engage in an identical manner the oppsoite end (not shown) of covering 12 and hold it taut parallel to and acoustically spaced from wall 22.

Accordingly, assembly 10 provides improved smoothness and continuity for wall covering sheet 12 and improved sound deadening properties, all at low cost and with ease of installation and use.

The description of assembly 10 is in reference to a vertical wall, Obviously, with a wall other than vertical, the description of the components of assembly 10 will be accordingly modified.

Figure 2

Figure 2:
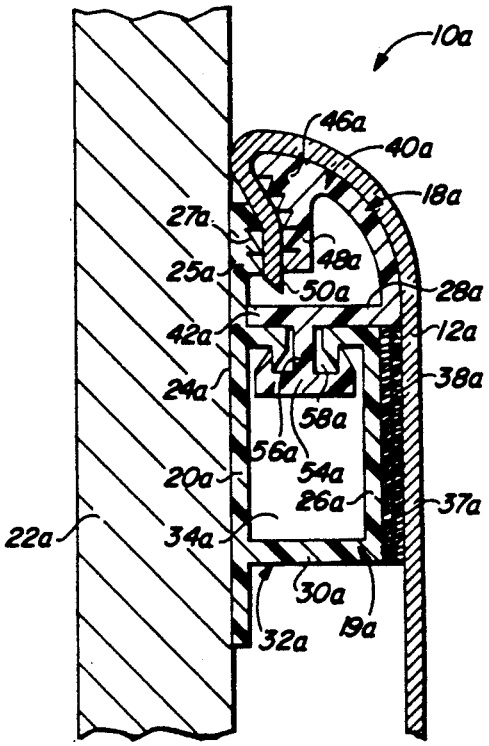

A second preferred embodiment of the present assembly is schematically shown in FIG. 2. Thus, assembly **10*a* is shown. Components thereof similar to those of assembly 10** bear the same numerals but are succeeded by the letter "a".

Assembly **10*a* is substantially identical to assembly 10, except that pad 52** is absent.

Figures 3 and 4

Figure 3:
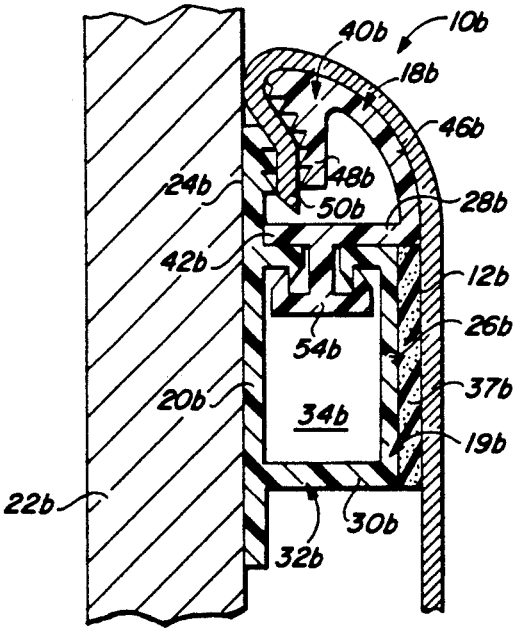
Figure 4:
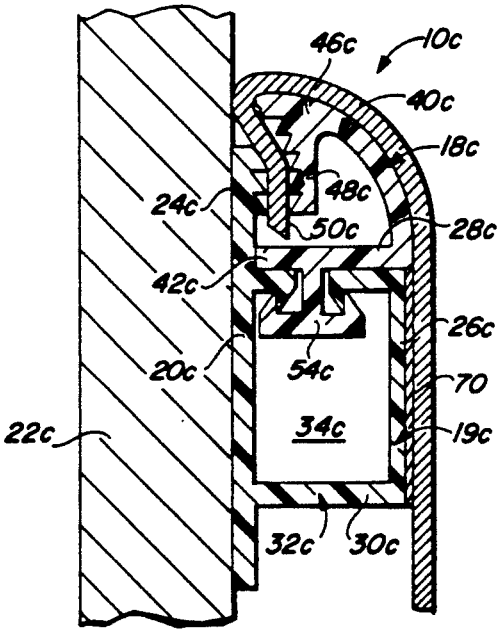

Third and fourth preferred embodiments of the present assembly are schematically depicted, respectively, in FIGS. 3 and 4. Thus, FIG. 3 shows assembly **10*b* and FIG. 4 assembly 10*c*. Components thereof similar to those of assembly 10 bear the same numerals, but are succeeded by, respectively, the letter "b" for FIG. 3 and the letter "c" for FIG. 4**.

Assembly **10*b* differs from assembly 10*a* only in that pad 37*b* is of resilient elastomeric foam instead of Velcro-type material. Assembly 10*c* differs from assembly 10*a* only in that a Velcro-type pad or any other pad is absent, plate 46*c* not overhanging the front of plate 26*c*. Instead, a thin layer 70 of adhesive is applied to seal covering 12*c* to plate 26*c***.

Assemblies **10*a*, 10*b* and 10*c* have substantially the advantages of assembly 10**, in that they are simple, light in weight, easy to fabricate and use, and provide superior visual and acoustical effects.

Figures 5 and 6

Figure 6:
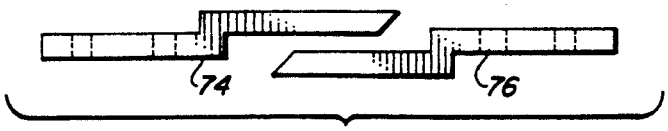
Figure 5:
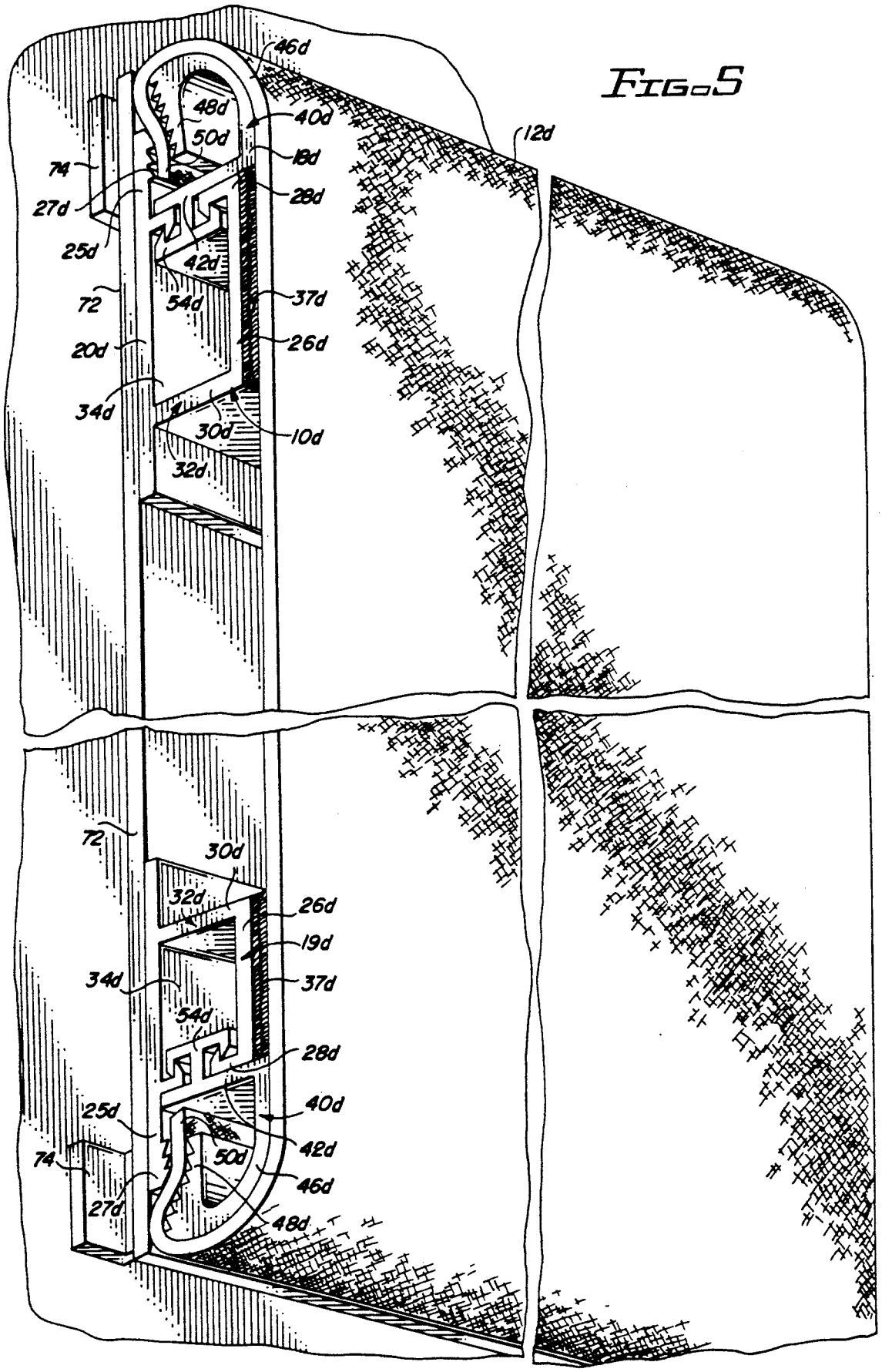

A fifth preferred embodiment of the improved assembly of the present invention is schematically depicted in FIGS. 5 and 6. Thus, assembly **10*d* is shown. Components thereof similar to those of assembly 10*b*** bear the same numerals but are succeeded by the letter "d".

Assembly **10*d* differs from assembly 10*b*** as follows:

a) two parallel strips **18*d* are shown spaced apart and facing away from each other with opposite ends 50*d* of covering 12*d*** releasably locked thereto;

b) assembly **10*d* includes a flat baseboard 72 to which strips 18*d* are rigidly connected with covering 12*d* stretched taut to overlie baseboard 72 in spaced acoustical relation thereto. Spaced stepped mounting hooks 74 are connected to baseboard 72 and adapted to mate with hooks 76 (FIG. 6) which can be affixed to a wall (not shown) in order to hang assembly 10*d* in place on such wall. A plurality of assemblies 10***d* can be used to cover such wall rapidly, effectively and decoratively.

Various other modifications, changes, alterations and additions can be made in the improved assembly of the present invention, its components and parameters. All such modifications, changes, alterations and additions as are within the scope of the appended claims form part of the present invention.

What is claimed is:

1. An improved wall covering assembly, said assembly comprising, in combination:

a) a flexible resilient wall covering having a front and a rear; and, b) at least one wall covering anchoring strip releasably connected to the rear of said wall covering, each of said strip being adapted to be secured to the exposed surface of a wall to hold said covering over said wall, each of said strip comprising:

1) a first member comprising:

a) a flat rear plate having a rear plate secureable to a wall,(said rear plate having a toothed front adjacent the upper end thereof, b) a front plate generally parallel to and spaced forwardly of said rear plate and fixed in place by, c) top and bottom integral struts spanning said plates, said two plates and said struts defining a generally closed box having an acoustical space, said top strut having a slot therein providing access to said space, said box also being open at opposite ends thereof, said toothed upper end of said base plate being above said box; and, 2) a second member slideably engaged with said first member and comprising:

a) a base plate adapted to be engaged with said top strut, b) an upwardly and rearwardly resilient curved plate connected to said base plate, and having a toothed depending lip normally abutting said toothed front of said rear plate, but temporarily movable forward thereof to provide a space therebetween, and c) connector depending from said base plate down through said slot in said top strut and keyed thereto so as to hold said first and second members together, said covering abutting the front of said strip and reflected over the upper end thereof and releasably engaged by said toothed upper end of said base plate and toothed front of said rear plate.

2. The improved assembly of claim 1 wherein said wall covering comprises at least one of cloth and plastic and is fire-retardant.

3. The improved assembly of claim 2 wherein the front surface of said front plate bears hooks, wherein said rear of said wall covering comprises hook-receptive material engaged with said hooks and wherein said wall covering has sound deadening properties.

4. The improved assembly of claim 1 wherein said strips comprise plastic.

5. The improved assembly of claim 1 wherein said strip is elongated and straight, wherein said struts and base plate are horizontal and said rear plate and front plate are vertical.

6. The improved assembly of claim 1 wherein said curved plate bears a Velcro-type strip releasably engaged with said wall covering.

7. The improved assembly of claim 1 wherein said curved plate overhangs said front plate and wherein said front plate bears on its front surface one of a strip of Velcro-hook-type material and a strip of foamed cushion material.

8. The improved assembly of claim 1 wherein said assembly comprises a panel which includes a baseboard member and a plurality of said strips in spaced parallel relation to each other and connected to said baseboard with said wall covering being connected to said spaced strips.

9. The improved assembly of claim 8 wherein said assembly includes panel hanging means secured to said baseboard to enable said panels to be attached to a wall.

10. An improved wall covering securing assembly for removably attaching a flexible resilient wall covering having a front and a rear to a wall, comprising:

a) at least one wall covering anchoring strip for releasable connection to the rear of said wall covering, comprising:

1) a first member having:

a) a flat rear plate securable to a wall, and having a toothed front adjacent the upper end thereof, b) a front plate generally parallel to said rear plate, c) top and bottom integral struts spanning said plates, said two plates and said struts defining a generally closed box having an acoustical space, said top strut having a slot therein providing access to said space, said box also being open at opposite ends thereof, said toothed upper end of said base plate being above said box; and, 2) a second member slideably engaged with said first member and comprising:

a) a base plate adapted to be engaged with said top strut, b) an upwardly and rearwardly resilient curved plate connected to said base plate, and having a toothed depending lip normally abutting said toothed front of said rear plate, but temporarily movable forward thereof to provide a space therebetween, and c) connector depending from said base plate down through said slot in said top strut and keyed thereto so as to hold said first and second members together, said covering abutting the front of said strip and reflected over the upper end thereof and releasably engaged by said toothed upper end of said base plate and toothed front of said rear plate.

11. The improved assembly of claim 10 wherein said wall covering comprises at least one of cloth and plastic and is fire-retardant.

12. The improved assembly of claim 11 wherein the front surface of said front plate bears hooks, wherein said rear of said wall covering comprises hook-receptive material engaged with said hooks and wherein said wall covering has sound deadening properties.

13. The improved assembly of claim 10 wherein said strips comprise plastic.

14. The improved assembly of claim 10 wherein said strip is elongated and straight, wherein said struts and base plate are horizontal and said rear plate and front plate are vertical.

15. The improved assembly of claim 10 wherein said curved plate bears a Velcro-type strip releasably engaged with said wall covering.

16. The improved assembly of claim 10 wherein said curved plate overhangs said front plate and wherein said front plate bears on its front surface one of a strip of Velcro-hook-type material and a strip of foamed cushion material.

17. The improved assembly of claim 10 wherein said assembly comprises a panel which includes a baseboard member and a plurality of said strips in spaced parallel relation to each other and connected to said baseboard with said wall covering being connected to said spaced strips.

18. The improved assembly of claim 17 wherein said assembly includes panel hanging means secured to said baseboard to enable said panels to be attached to a wall.

* * * * *